US007624978B2

(12) United States Patent
Kaiping

(10) Patent No.: US 7,624,978 B2
(45) Date of Patent: Dec. 1, 2009

(54) SHEET FEEDER WITH FEED BELTS THAT MOVE TOWARD AN AWAY FROM EACH OTHER

(76) Inventor: James C. Kaiping, 3623 Sweet Briar La., Columbia, IL (US) 62236

( * ) Notice: Subject to any disclaimer, the term of this patent is extended or adjusted under 35 U.S.C. 154(b) by 646 days.

(21) Appl. No.: 11/145,855

(22) Filed: Jun. 6, 2005

(65) Prior Publication Data

US 2006/0220299 A1 Oct. 5, 2006

Related U.S. Application Data

(60) Provisional application No. 60/662,484, filed on Mar. 16, 2005.

(51) Int. Cl.
*B65H 3/04* (2006.01)

(52) U.S. Cl. ..... 271/35; 271/165; 271/171; 271/10.06; 271/4.05; 198/644; 198/626.5

(58) Field of Classification Search ..... 271/165, 271/171, 34, 35, 10.06, 4.05; 198/644, 626.3, 198/626.5, 817, 810.03
See application file for complete search history.

(56) References Cited

U.S. PATENT DOCUMENTS 3,086,772 A * 4/1963 Vogel ..... 271/35
3,664,660 A * 5/1972 Runzi ..... 271/35
3,970,298 A * 7/1976 Irvine et al. ..... 271/34
4,037,769 A * 7/1977 Meyers ..... 271/240
4,081,181 A * 3/1978 Crowe et al. ..... 271/3.01
4,192,496 A * 3/1980 Baselice et al. ..... 271/10.07
4,436,469 A * 3/1984 Kelly ..... 412/16
4,478,400 A * 10/1984 Commers ..... 271/3.03
4,603,846 A * 8/1986 Miles ..... 271/2
4,705,265 A 11/1987 Hirota et al.
4,712,783 A * 12/1987 Selak ..... 271/100
4,767,115 A * 8/1988 Garthe ..... 271/223
5,213,319 A * 5/1993 Crowe et al. ..... 271/10.06
5,234,208 A * 8/1993 Bandura et al. ..... 271/34
RE34,894 E * 4/1995 Golicz ..... 271/6
5,527,027 A * 6/1996 Flade et al. ..... 271/94
6,050,563 A * 4/2000 Vedoy et al. ..... 271/10.07

FOREIGN PATENT DOCUMENTS

JP 63258323 A * 10/1988

* cited by examiner

*Primary Examiner*—Patrick H Mackey
*Assistant Examiner*—Gerald W McClain
(74) *Attorney, Agent, or Firm*—Polster Lieder Woodruff & Lucchesi, L.C.

(57) ABSTRACT

A sheet feeder having a stack hopper for holding a stack of sheets, and feed belts for advancing the bottom-most sheet from the stack, is constructed to move at least one of the feed belts laterally toward and away from another of the feed belts while the belts are being driven. Preferably, side guides extend substantially to the end of the feeder, and extend both above and below the upper surface of belts to which they are adjacent. The belts extend between and around shafts of uniform diameter through the reach of lateral movement of the belts. The shafts are journaled in bearings mounted in such a way that they can be lifted out to change belts quickly and easily.

16 Claims, 11 Drawing Sheets

SHEET FEEDER WITH FEED BELTS THAT MOVE TOWARD AN AWAY FROM EACH OTHER

CROSS REFERENCE TO RELATED APPLICATIONS

Applicant claims priority to provisional Application No. 60/662,484, filed Mar. 16, 2005 and herein incorporated by reference.

STATEMENT REGARDING FEDERALLY SPONSORED RESEARCH OR DEVELOPMENT

Not Applicable

BACKGROUND OF THE INVENTION

This invention relates generally to sheet feeders of the stand alone type or the type used to feed sheets of varying sizes and thicknesses into other production equipment for processing. The feeder of this invention was first designed for sheets of paper, but it has been found to have much broader application. Accordingly, the term "sheet" as applied to the feeder of this invention is used herein to encompass not only paper, for which prior art feeders have been designed, but also such things as CDs, credit cards, labels, calendars, or any other object, generally on the order of a few thousandths of an inch to about ⅜ of an inch thick, and sufficiently flexible to flex on the order of 1/16 to ⅛ inch, that can be fed from a stack.

There are hundreds or even thousands of paper sheet feeders made for thousands of uses. Typically, high speed sheet feeders are used when it is desired to run a large volume of paper material through equipment for processing such as printing, folding, addressing, labeling, packaging and many other purposes. Most feeders of this type include a generally vertical hopper with paper side guides wherein a stack of paper material is placed in a near vertical stack. The bottom sheet of the stack is typically pulled forward into the feeder by a series of feed rollers or feed belts. A sheet separator, or multiple sheet separators are placed typically over the feed belts or feed rollers and are adjusted vertically to allow a single sheet to be pulled through while inhibiting the movement of the remainder of the stack. Once the bottom sheet leaves the area of separation, the next sheet from the bottom of the stack is allowed to pass under the separators.

Sheet feeding machines developed to date have either fixed position feed rollers or fixed position feed belts. Most of these feeders are built to handle a variety of sizes of paper, therefore the position of these belts or rollers may not be optimum for every size sheet. In addition, most of these feeders, due to their lack of lateral adjustment of the belts and rollers, use side guides whose bottom edge extends to just above the feed belts or rollers, due to the fact that they must be positioned over the belts or rollers on small sheets. Additionally, these side guides only extend lengthwise through the feeder in the paper hopper area, limiting its ability to guide sheets once they leave the hopper.

Although the existing feeders of the prior art have moderate success running a variety of paper sizes and thicknesses, the lack of effective side guides causes a great deal of paper skewing or crooked feeding which causes many problems on the machine to which the feeder is attached.

The present invention relieves sheet skewing by using feed belts that are repositionable while the belts are being driven, and side guides that extend from the feed hopper through the entire length of the feeder. These guides also extend downward below the surface of the feed belts so sheet materials cannot slip underneath the guides as is common with existing feeders. Because the prior art feed belts did not offer lateral adjustment, the side guides could not extend below the surface of the feed belts.

Additionally, the prior art feeders typically utilize dual separators of fixed position, which are positioned over the top of firm feed rollers or belts. When set for thickness, these separators and the hard surface below them create a nip point which creates undo pressure on the sheet, causing jams, or force the top layer of a multi-layered piece to buckle backwards, causing jams. Furthermore, the prior art separators are made to move together, making no allowance for differences in thickness across the width of the sheet.

The present invention alleviates this problem by allowing independent positioning, both laterally and in a direction toward and away from the sheet being fed of the sheet separators between the feed belts, so that they force separation of the stack by buckling the bottom sheet away from the stack. Since this area between belts does not present a hard surface level with the feed belts, this design does not create a high pressure nip point, thereby reducing jams.

On feeders of this prior art type, the sheet separators are usually made of a curved surface, typically a roller which is either stationary or rotates counter to the direction of the paper. These surfaces usually have a rubber or stone coating which creates extra friction to hold back the stack while the bottom piece is being fed. Although these surfaces generally work for a variety of paper types, sometimes they offer too much friction, either scratching the surface of glossy paper or causing jams by not allowing the bottom sheet through smoothly.

The present invention alleviates this problem by offering a separator tip that is simple to remove and replace, which can be replaced with tips of various materials that offer differing levels of friction.

Most standard feeder types of the prior art typically consist of a series of transport rollers and shafts that are supported by bearings on both ends. These bearings are typically mounted to the machine housing in recessed cutouts made specifically to house the bearings. Although this works well functionally it makes replacing the transport shafts, rollers or belts difficult, as the side frame, or transport assembly must be wholly removed from the feeder to perform this common service.

The present invention alleviates this problem by utilizing simple drop-in shafts, supported by a platform for the bearings to rest on, and capped off by an easily removable cap, which does not require disassembly of the side frame or transport assembly for service. The bearings on the end of the transport shafts are held in position by simple bearing blocks, from which the bearings and shafts can be lifted.

Finally, existing feeders typically include a paper support wedge, which is used to bias the stack of paper downward and forward toward the exit of the feeder. These wedges typically offer some adjustment for different paper sizes but do not extend past the rear end of the feeder, causing difficulty in running long paper.

The present invention remedies this by including a sheet support wedge with a reversible design and extended mounting bracket, which allows for short and long sheets.

BRIEF SUMMARY OF THE INVENTION

In accordance with this invention, generally stated, a sheet feeder is provided which includes a stack hopper for holding a stack of sheets, feed belts for advancing the bottom-most sheet from the stack, and means for moving at least one of the feed belts laterally toward and away from another of the feed belts. Preferably, two marginal feed belts, adapted to be positioned along side margins of the sheets, are moved toward and away from one another. Side guides extend from the feed hopper through the entire length of the feeder. These guides also extend downward below the surface of the feed belts. Preferably, the moveable feed belts are driven by and extend over smooth upper and lower shafts of uniform size through the range of lateral adjustment of the belts, so that the belts can be moved laterally while they are being driven. The shafts are journalled in bearings at their ends, the bearings being mounted on a base bar of a channel, and held against upward displacement by an easily removable cap strip.

DETAILED DESCRIPTION OF THE PREFERED EMBODIMENT

Figure 4:
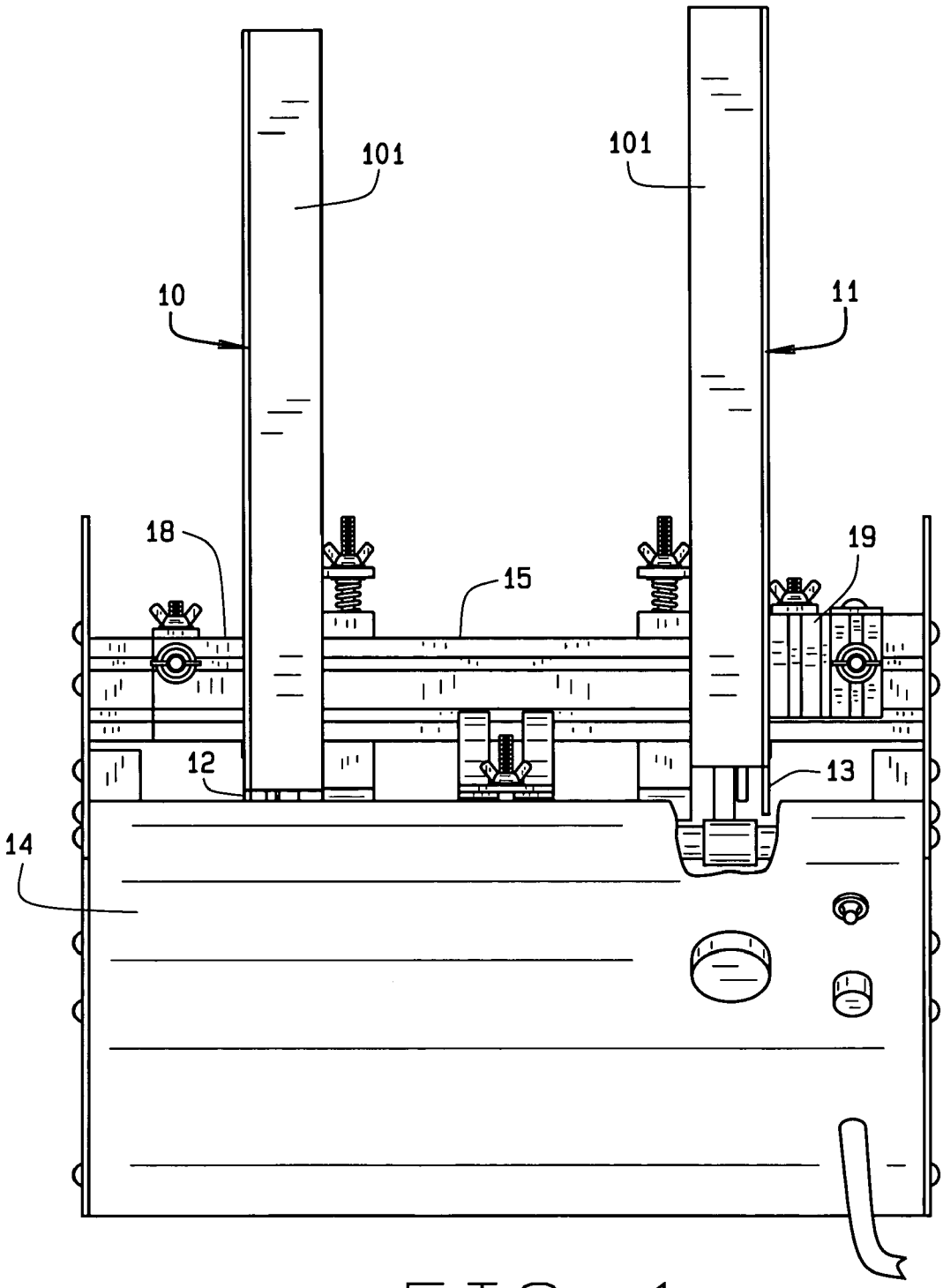
FIG. 4 is a view taken along the line 4-4 of FIG. 1, partly broken away.

Referring to the drawings, reference numeral 1 indicates a completed feeder with side frames 2, support wedge 4, feed belts 5, 6 and 7 (FIG. 2), and a hopper 9 defined in part by side plates 10 and 11 (FIG. 2), each of which has a retaining flange 101. The side frames 2 together with a back plate 14 (FIG. 4) and bottom platform 16 (FIG. 9) form a housing 17.

In this embodiment, side plates 10 and 11 (FIG. 2) are integral with side guides 12 and 13 (FIGS. 4, 9), which extend substantially through the entire length of the feeder. As shown particularly in FIG. 9, these guides also extend downward below the surface of the feed belts so sheet materials cannot slip underneath the guides as is common with existing feeders. The feeder 1 also includes a bridge 15 (FIG. 2), extending between the side frames 2.

Figure 3:
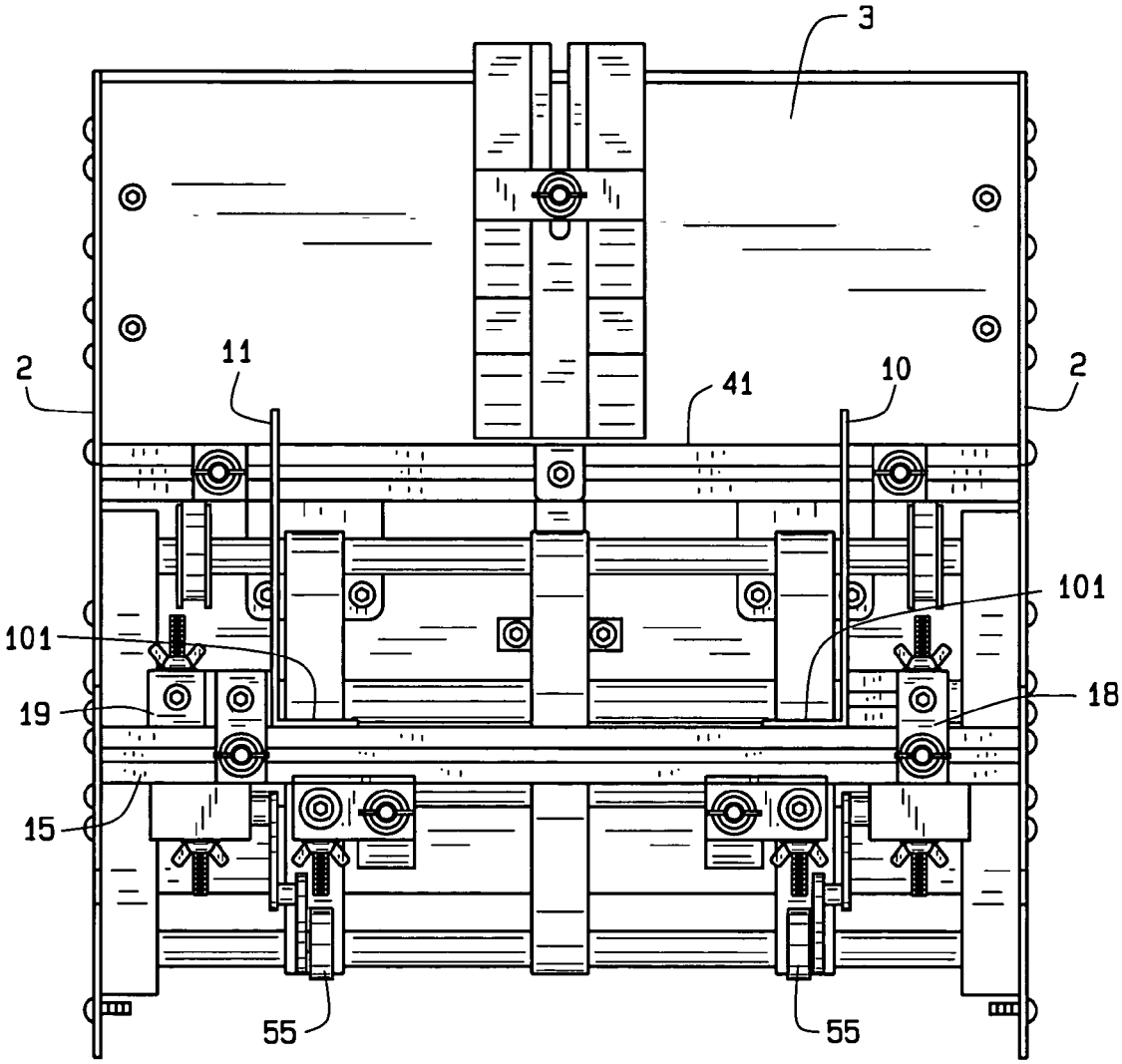
FIG. 3 is a view taken along the line 3-3 of FIG. 1.

Upper platform 3 (FIG. 3) is sloped downward towards the front or exit end of the feeder.

Figure 1:
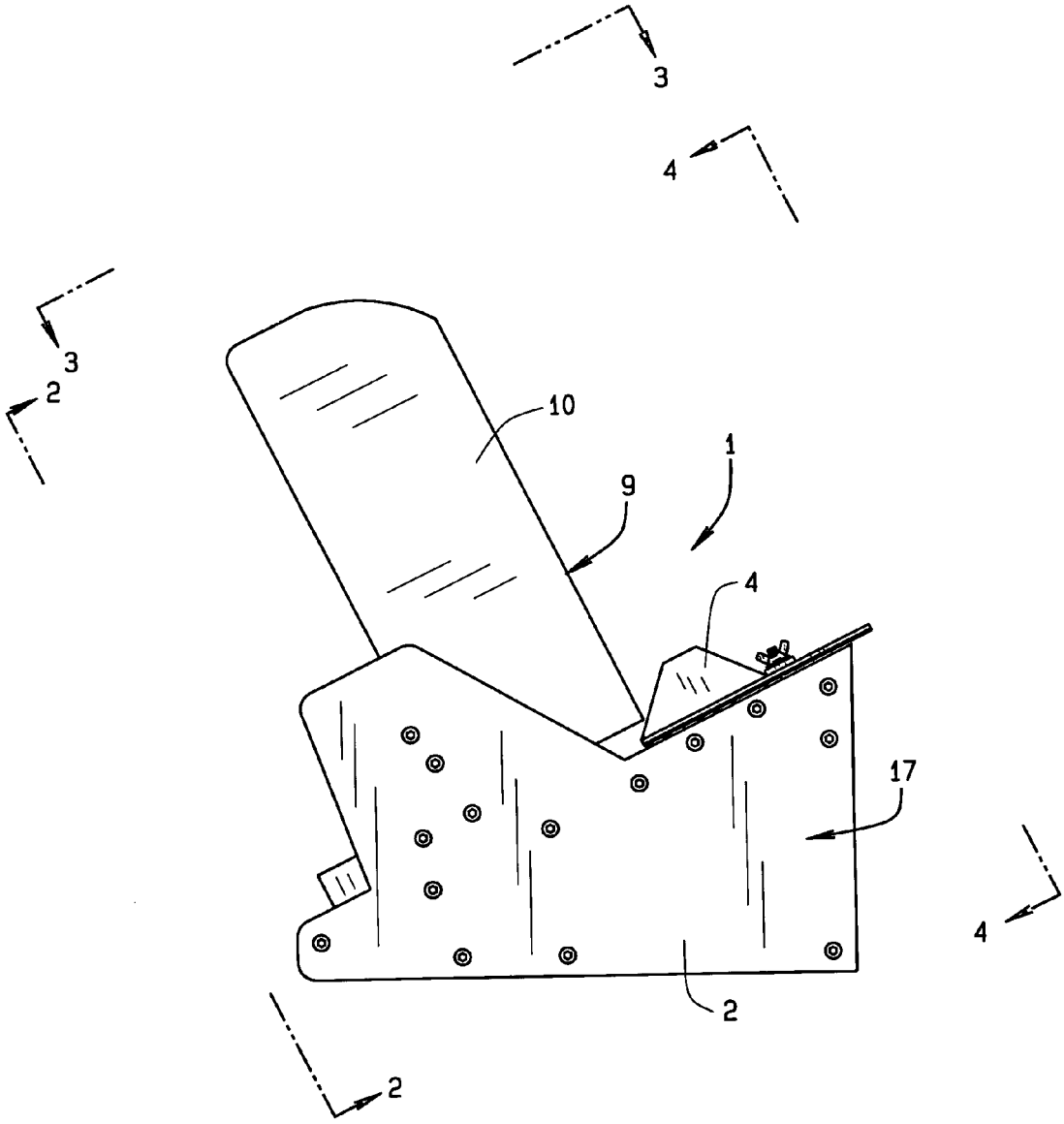
FIG. 1 is a view in side elevation of one embodiment of sheet feeder of this invention.

A stack of sheets 8 (FIG. 9) to be fed is placed on the upper platform 3 with a leading portion of the bottom sheet in contact with feed belts 5, 6 and 7 and a following portion on the adjustable support wedge 4 (FIGS. 1,9), to bias the sheets toward the feed belts.

Side guides 12 and 13 (and side plates 10 and 11), mounted in sliding mounts 18 and 19 (FIG. 4) on the bridge 15, are positioned against the sides of the stack 8 to guide sheets through the feeder. The side plates 10 and 11 extend vertically above the feeder to hold a large stack of sheets and, as side guides 12 and 13, extend underneath the bridge and, in the posture shown in the drawings, alongside above and below the outboard edges of feed belts 5 and 7, substantially to the exit end of the machine, ensuring straight feed all the way. As has been pointed out, the side guides extend below the surface of the feed belts so as to keep sheets from slipping underneath the side guides. In the embodiment shown, particularly in FIG. 4, the mount for the side plate 11 is made to permit the side guide 13 to be raised above the level of the upper surface of the belts, so as to permit a belt to be moved beneath it, or to permit the guide to be moved to a space between belts, and then dropped to serve its regular function.

Figure 5:
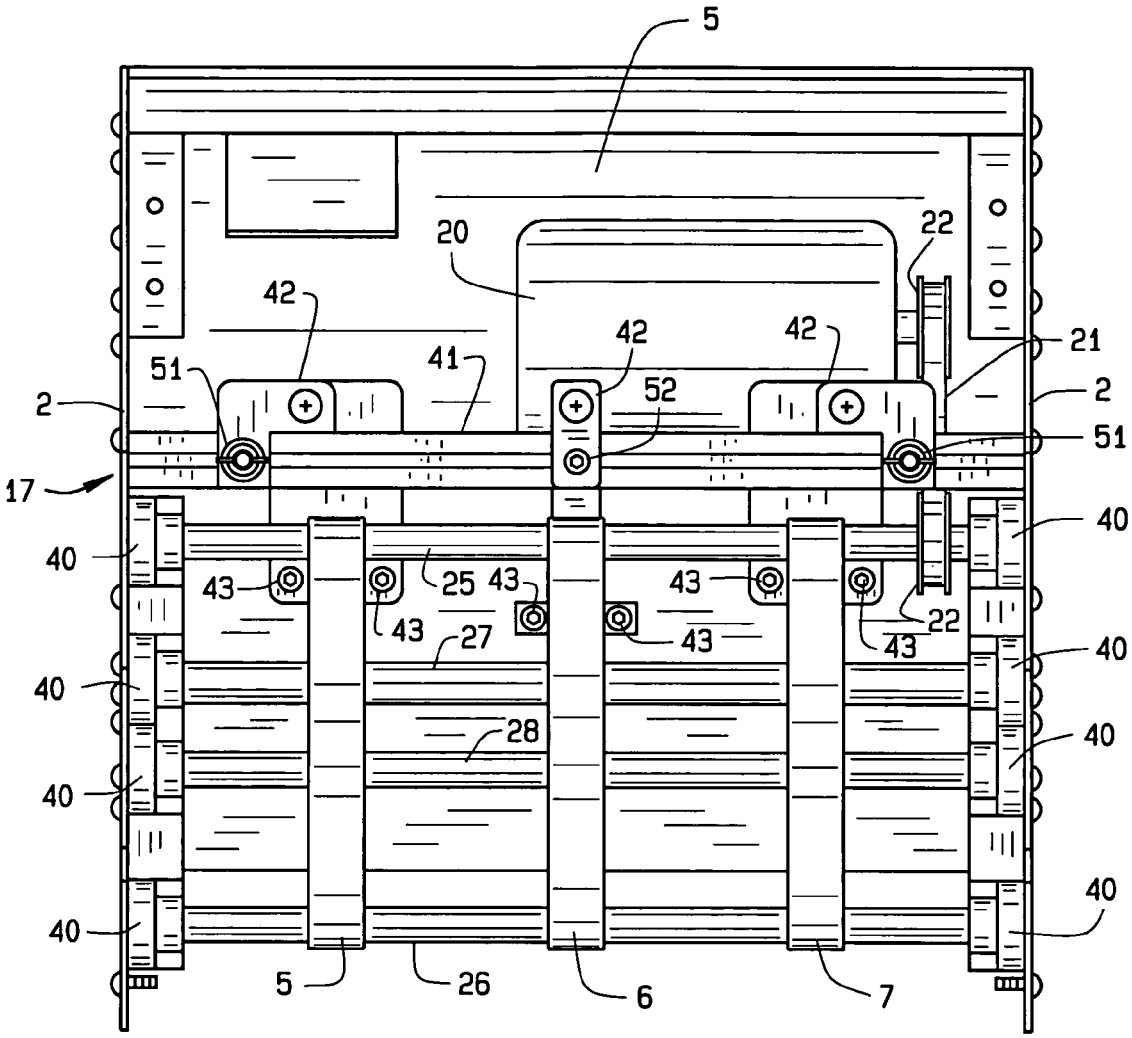
FIG. 5 is a view corresponding to the view in FIG. 3 with parts removed, showing, inter alia, feed belts, smooth belt drive-, support- and idler shafts, and bearings.
Figure 5A:
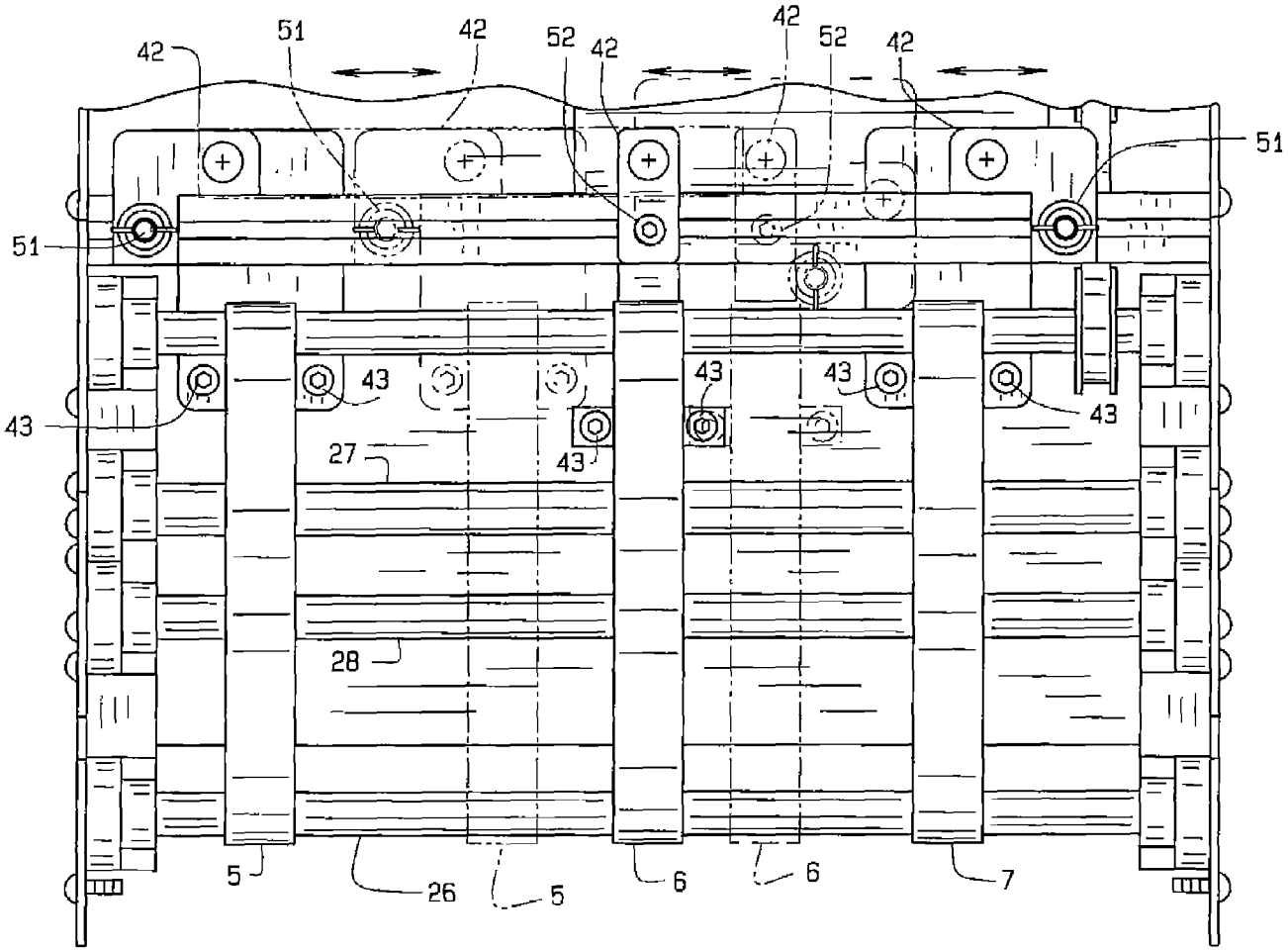
FIG. 5A is a view correspondipgfto the view in FIG. 5, showing in dotted lines, movement of belts 5 and 6 and indicating the movement of belts 5, 6 and 7.

As shown in FIG. 5, within the housing 17 is a motor 20, which drives a feed belt drive shaft 25 by means of a timing belt 21 and pulleys 22. The feed belt drive shaft 25 drives the feed belts 5, 6 and 7 that are trained over an idler support shaft 26 and support shafts 27 and 28. These belts move the bottom sheet of the stack 8 forward toward the exit end of the feeder, using friction.

Two sheet separators 30 and 31 (FIGS. 2,7) are mounted in sliding mounts 32 and 33 on bridge 15 and can be positioned laterally (transversely) of the sheet, independently of one another, and locked in position with lock knobs 23, between the feed belts. These separators can then be adjusted up or down independently with a separator adjustment knob 34 to allow only the bottom sheet of the stack 8 to pass through the feeder. The movement of the separators up or down is sometimes referred to hereinafter as vertical movement to distinguish from lateral movement of the separators.

Figure 11:
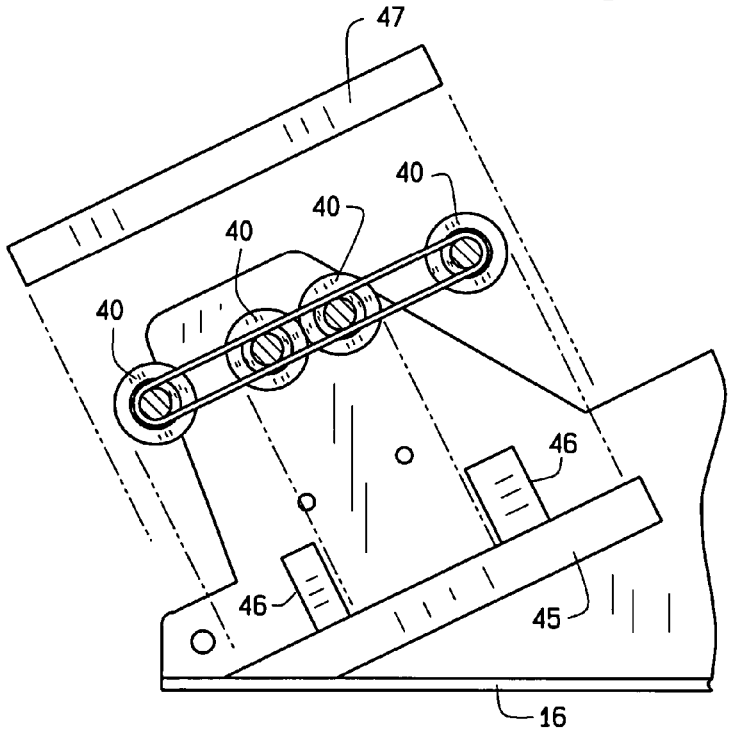
FIG. 11 is an exploded view of the feeder shown in FIG. 1 partly in section, with one side frame removed, showing the placement of bearings in this embodiment.

Each shaft 25, 26, 27 and 28 is mounted in bearings 40 (FIGS. 2, 5,11) at both ends. These bearings rest on a shaft support bar 45, as shown particularly in FIGS. 9 and 11, which keeps all four shafts on exactly the same plane. The shaft support bar 45 is supported at the appropriate downward angle by bolts through the side frames 2 and a cross bar, not here shown. Blocks 46 on the bar 45 (FIGS. 9, 11) confine the bearings of shafts 27 and 28, and serve as stops for the bearings of shafts 25 and 26. A bearing support cap 47 (FIG. 11) slides into place over the blocks, and is held in position by bolts through the contiguous side frame, to prevent upward movement of the bearings. The feed belts are stiffly resilient, exerting tension on the shafts 25 and 26. The feed belts wear out with use. Replacing feed belts in conventional machines is a tedious and difficult job, requiring removal of side frames. Replacing the feed belts in the feeder of this invention is simple and quick. The cap 47 is removed, the shafts and their bearings are lifted off the support bar, the belts are replaced and the shafts reinstalled, a matter of minutes compared with a good part of an hour with conventional feeders.

The shafts 25-28 are smooth, and except for a flat on the drive shaft 25 to accommodate the pulley 22, of uniform diameter throughout their length, even at their ends, where they are mounted in their bearings. Use of bearings to accept shafts of uniform size simplifies manufacturing and provides a much heavier bearing than conventional feeders use. Of course, when the shafts are of uniform diameter throughout the belt-engaging reach of the shafts, the belts can be moved while they are being driven.

In the embodiment shown, each of the belts has a feed belt guide bracket 42 (FIG. 5) that carries a feed belt mover with posts 43, positioned below and extending a short distance above a lower reach of the movable belts. As shown particularly in FIG. 5, the brackets 42 are moveably mounted on a belt bracket bridge 41 extending between and fastened to the side frames 2. They can be moved manually by loosening locking knobs 51 or set screw 52, as the case may be, and then tightening the nut or set screw. The posts 43 can be positioned near the drive shaft 25, for convenience, because the belts, when running, are self-aligning. The belts generally have a reach on the order of eight inches, and are on the order of one inch wide, so that lateral movement of the moving belt on the drive shaft 25 is followed almost immediately by lateral movement of the belt on the idler shaft 26. These dimensions are, however, merely illustrative.

Figure 2:
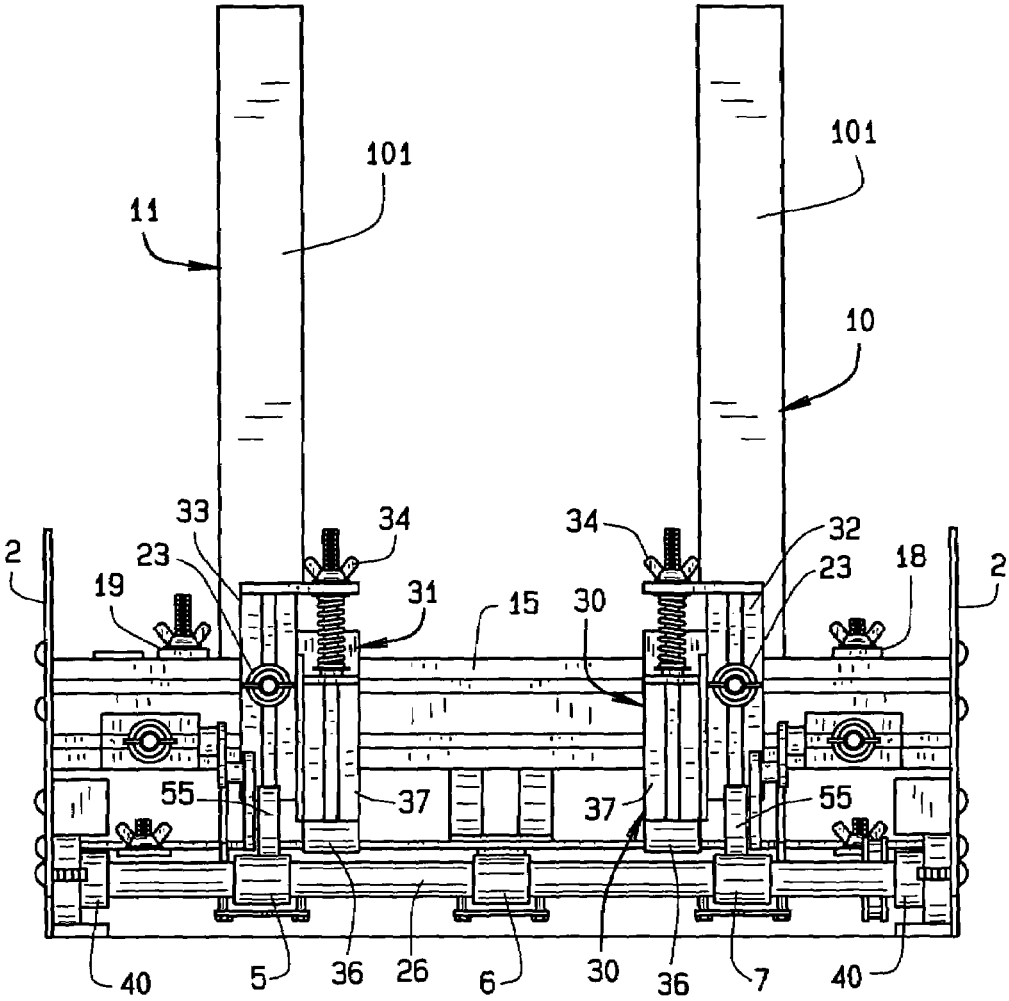
FIG. 2 is a view in front elevation, in the direction indicated by the line 2-2 of FIG. 1.
Figure 7:
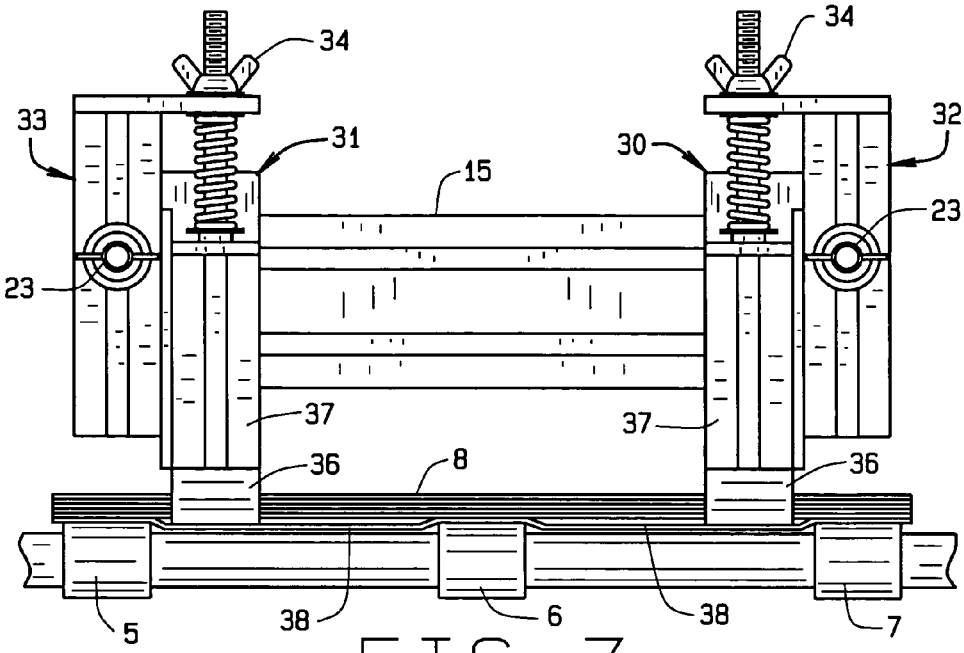
FIG. 7 is a fragmentary view of one embodiment of separators of the present invention.
Figure 8:
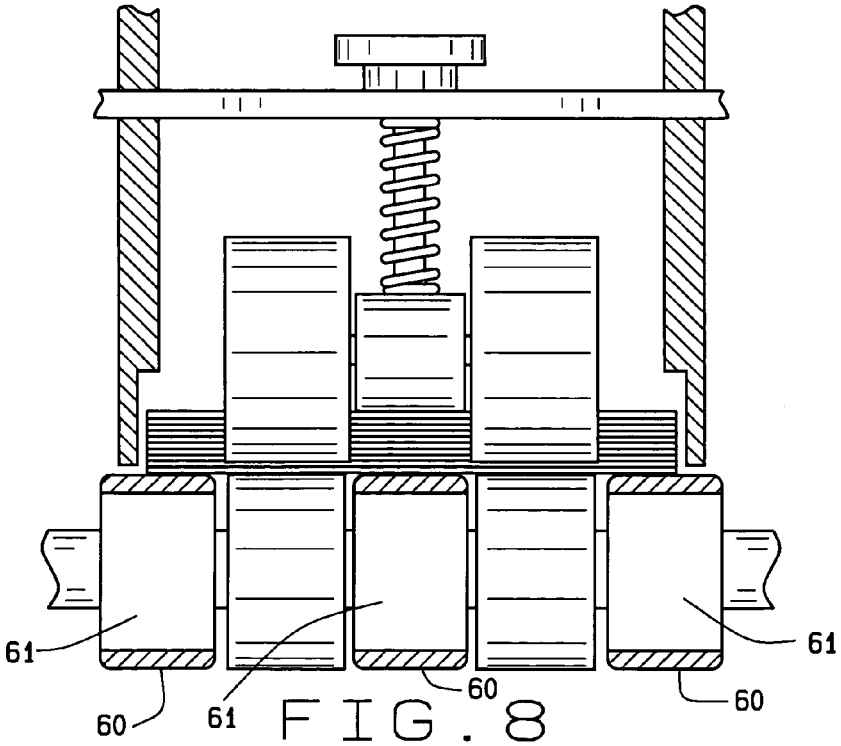
FIG. 8 PRIOR ART
FIG. 8 is a view corresponding to the view in FIG. 7, of a prior art feeder.
Figure 7A:
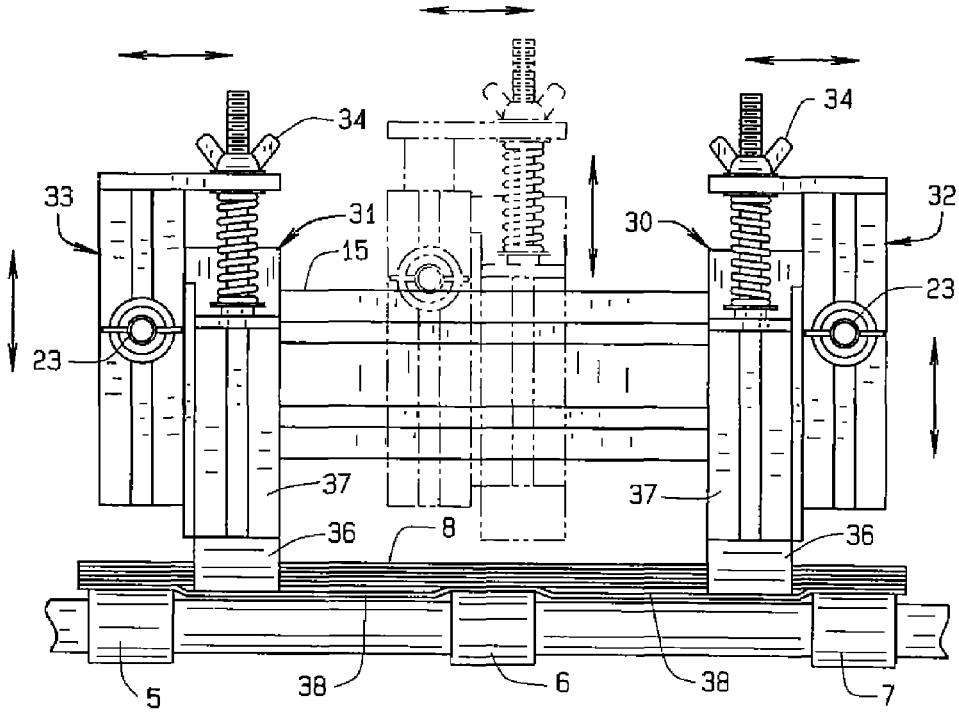
FIG. 7A is a view corresponding to the view in FIG. 7, showing, in dotted lines, movement of separator 31 and indicating the movement of separators 31 and 32.
Figure 9:
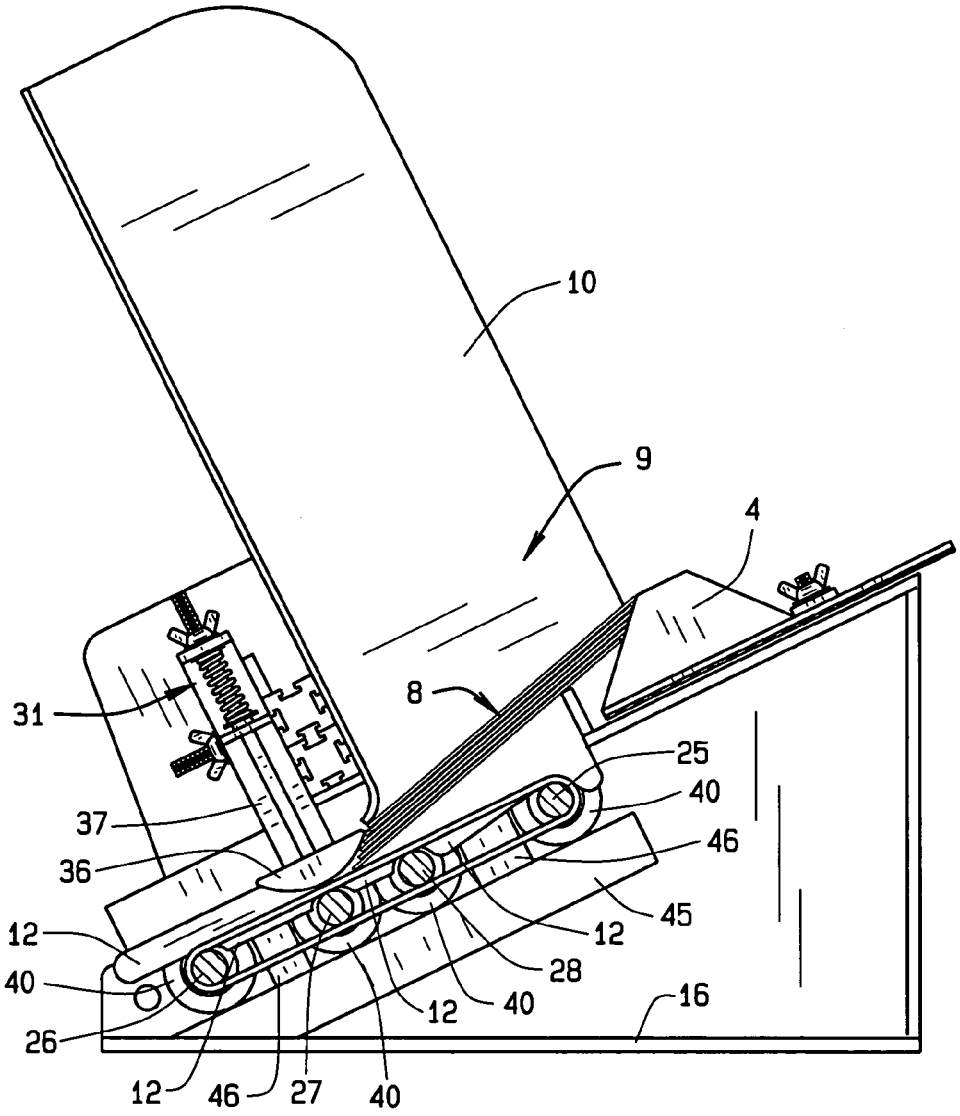
FIG. 9 is a view in side elevation, partly in section, of the feeder shown in FIG. 1, with a side frame removed.
Figure 10:
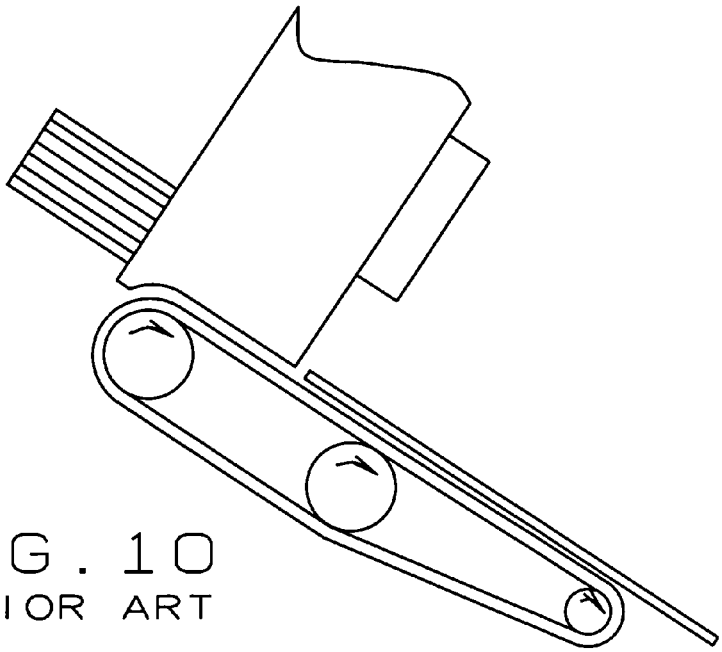
FIG. 10 PRIOR ART
FIG. 10 is a somewhat diagrammatic view of a prior art feeder, showing a guide above the upper surface of a feed belt.

As shown in FIGS. 2, 7 and 9, the separators 30 and 31 are made up of a separator tip 36 and a separator block 37. The tip 36 is attached to the separator block 37 with a single bolt. Separator block 37 is mounted to the bridge 15 on sliding mechanisms 32 and 33, which allows the operator to position each separator individually in the most strategic lateral position possible. The height of separators 30 and 31 is individually adjustable by turning a separator adjustment knob 34 so as to accomodate sheets of thickness varying from a few thousandths to ⅜" thick, and to allow for differences in thickness across the width of the sheet being fed. For example, such a difference may be the result of folding, the thickness at the fold being greater than at the open side of the sheet. The separator tip 36 has a largely curved side facing the stack 8 so as to shingle the lower portion of the stack as it approaches the lowest point of the separator. This shingle effectively relieves the friction between sheets in the stack allowing for easier separation. As shown particularly in FIG. 7, The separator tip is positioned between the feed belts and pushes down slightly on the bottom sheet as it passes underneath. This forces a small buckle, on the order of 1/16" to ⅛" for example, downward in the sheet, further breaking its frictional bond with the sheets resting on top, which are not buckled. As distinguished from the separators of the prior art, which have a tight, hard nip point to separate the sheets, see FIG. 8, which leads to tearing and jamming of the sheet, particularly of folded sheets, and misalignment, particularly of sheets that vary in thickness from one side to the other, the separators 30 and 31 exert almost no frictional force on the sheet, but at the same time, separate the sheets effectively. As is also shown in FIG. 8, in conventional feeders, the separators are tied together, moving as one, so that no provision is made for gradations in thickness across the width of the sheet.

As the lowermost sheet passes out of the feeder and away from the separators 30 and 31, the next sheet in the stack is allowed to begin travel on the belts and underneath the separators. In the embodiment shown in FIGS. 2 and 3, swinging eject wheels 55 are mounted for selective lateral movement on the bridge 15. These wheels, which are gravity biased to touch the feed belts 5 and 7, are similar to such wheels used in conventional machines, except that wheels 55 can be moved laterally to keep up with the lateral movement of the belts. The wheels 55 serve to assist the final movement of the sheet from the feeder.

The drive arrangement for the present invention is shown as a top view in FIG. 5. It will be seen in FIG. 5 that the drive system consists largely of a motor 20, mounted on the bottom platform 16, which drives drive shaft 25 by means of timing belt 21 and pulleys 22. This is a standard method of drive for sheet feeders, offers no special requirements and by no means limits this design to specific motors, speed controls or pulleys.

Figure 6:
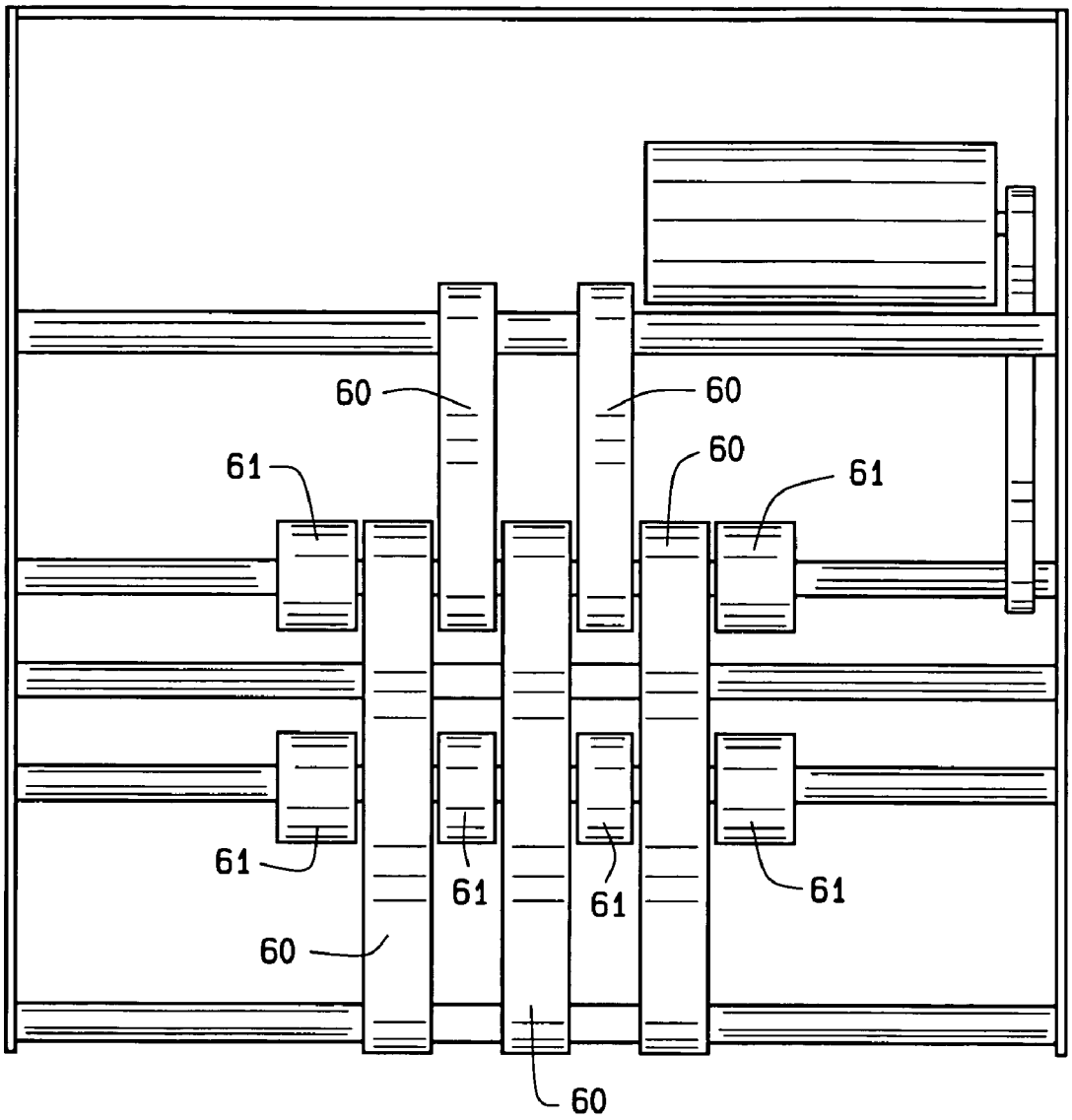
FIG. 6 PRIOR ART
FIG. 6 is a view generally corresponding to the view in FIG. 5 of a prior art feed belt arrangement.

FIG. 6 is a top view of a standard prior art drive and belt arrangement. In FIG. 6 it can be seen that a motor drives a drive shaft with a timing belt and pulleys similar to the present invention, except that the drive shaft has "tires" 61, as shown in FIG. 8, areas of greater diameter than the rest of the shaft, over which feed belts 60 run. The drive shaft then drives a series of such feed belts 60, which are also trained over tires on a belt support shaft, an upper shaft and a lower idler shaft. Feed rollers 61, which have generally the same surface height as the feed belts, are also driven in the same direction as the feed belts. It can be seen in FIGS. 6 and 8, that in the "prior art" feeder shown, the lateral position of the feed belts and/or feed rollers is not adjustable while the belts are being driven, and not readily adjustable when the belts are not, even when the tires are rings mounted on the shafts and secured by set screws or the like. In the latter case, the machine must be practically dismantled to change the position of the tires, because the belts must be removed, the rollers 61 removed or repositioned, and the tires on all of the shafts must be moved and resecured. Because for all practical purposes, then, these feed belts 60 cannot be moved laterally, and many sheet sizes are smaller than the width of the belts, the side paper guides cannot extend through the entire length of the feeder above and below the top surface of the belts and therefore usually end at the bridge. These guides are spaced above the upper surface of the feed belts, which permits skewing of the sheets, leading to misalignment or misregistry of the sheets in the machine into which the sheet is being fed, or jamming.

In FIG. 5, the present invention, it can be seen that since the outer two feed belts 5 and 7 are adjustable laterally, they can be moved toward and away from the center of the feeder allowing for consistent friction and feeding of many sizes of sheet. In the preferred embodiment shown, the center belt 6 is also movable, so that for very narrow stock, the side guide 11,13, can be lifted above the belt 5 and moved adjacent the belt 6, which can have been moved close to the belt 7. For extremely narrow stock, the belt 6 can be moved out of the way, and guide 11,13 can be positioned next to the belt 7 itself. In any case, the guides should be spaced a short distance from the edge of the belt to which it is adjacent, so as not to abrade the edge of the belt or impede the travel of the belt.

The sheet separator arrangement for the present invention is shown in FIGS. 2 and 7. It can be seen in FIG. 7 that two separate separator assemblies are mounted on bridge 15 with the stack of sheets resting behind the separators. Using the separator positioning knob 23, the machine operator can position separators 30 between feed belts 5 and 6. Using separator adjustment knob 34, with which both separators are equipped, the operator can lower each separator tip 36 independently down onto a single sheet until slight buckles 38 are produced in the sheet. The buckle 38 assists in breaking the frictional bond between the bottom sheet of the stack and the sheets above it. Since each separator can be adjusted independently of the other, sheets with varying thicknesses can easily be accommodated.

Numerous variations in the construction of the feeder of this invention, within the scope of the appended claims, will occur to those skilled in the art in light of the foregoing disclosure. Merely by way of example, any number of intermediate belts can be provided, and may be movable or immovable. An appropriate number of separators can be positioned between the belts. Any number of ejector wheels can be employed, to engage one or more of the belts. One of the guides and its contiguous belt can be made laterally immovable. In that case, the narrower sheets will always abut the immovable guide, and a movable belt and its guide are positioned along the other edge. The disadvantage of such an arrangement is that it limits the positioning of any fixed intermediate belt to a place near the stationary guide, else it interferes with the movement of the movable belt, and therefore limits the narrowness of the sheet to be fed and constrained by the movable guide, and it also positions the stack asymmetrically with respect to the wedge 4. The latter problem can be solved by making the wedge pyramidal and permitting it to be swung toward the immovable side plate. Other means for moving the belt moving brackets and separators can be employed, as, for example, separate lead screws journalled in bosses fixed to the machine frame or to the bridge, and extending through internally threaded blocks of a belt adjusting bracket or a separator. The belt-engaging posts of the embodiment described can take the form of rollers, or of upright surfaces of channels. The number of separators, independently movable, is not limited, depending upon the number of belts and their positions, and the requirements of the stock, for example. The belt shafts can be made of larger diameter, and reduced in diameter at the ends to permit the use of smaller bearings, something that can also be done with the shafts shown and described, although, as has been pointed out, the use of shafts of uniform diameter all the way to their ends has advantages. Tires, moveably mounted on splined or flatted shafts, for example, could be used, with moving mechanisms preferably engaging the tires on the drive and idle shafts, but this construction is more expensive, complicated and liable to have more operational and maintenance problems than the embodiment shown and described. They would still require a shaft of uniform diameter through the reach of movement of the belts. Although making the outwardly extending side guides of one piece with the hopper side plates is an effective and inexpensive way to make them, they could be made separately and riveted or otherwise secured to the side plates. These variations are merely illustrative.

The invention claimed is:

1. A sheet feeder comprising a stack hopper for holding a stack of sheets, a plurality of rotatable shafts, at least one of which is driven, at least one of which is positioned under said stack sheets, and at least one other of said shafts, parallel to said one of said shafts, is spaced forward of a leading edge of said stack, and a plurality of feed belts extending around and between said one shaft and said other of said shafts, said feed belts being spaced laterally from one another along said shafts, at least one of said feed belts being movable laterally along said constant diameter shafts toward and away from another of said feed belts while said feed belts are being driven.

2. The feeder of claim 1 wherein said feed belts move laterally independently of one another.

3. The feeder of claim 1 including side guides closely adjacent side margins of said sheets and extending from said stack hopper forwardly of said hopper above and below an upper surface of said laterally movable feed belts.

4. The feeder of claim 3 wherein said side guides are movable laterally to remain alongside side margins of said sheets when said feed belts are moved laterally to accommodate sheets of different widths.

5. The feeder of claim 3 wherein said side guides include side plates forming a part of said hopper, and a part of said side guides extends above and below said upper surface from said hopper part forwardly at least to the outer end of said feed belts.

6. The feeder of claim 5 wherein said extending side guides are positioned inboard of outer ends of supporting shafts over which said feed belts run and immediately outboard of said feed belt or belts, and are laterally movable to conform to the positions of the said feed belt or belts.

7. The feeder of claim 1 wherein marginal feed belts are mounted on and extend between an upper shaft and a lower shaft, said shafts being of constant diameter through the range of lateral adjustment of said feed belts, and said feed belts being movable by posts on either side of each of said feed belts, said posts being carried by brackets movable along a feed belt guide support.

8. The feeder of claim 1 wherein at least one movable feed belt is mounted on and extends between an upper shaft of uniform diameter through the range of lateral movement of siad feed belt and a lower shaft of uniform diameter through the range of lateral movement of said feed belt, and wherein said shafts are journaled in bearing blocks and removably mounted in an open-topped channel closed by a removable cover.

9. The feeder of claim 1 including at least one eject wheel mounted for lateral movement to be positioned above a laterally movable feed belt when said feed belt is moved laterally.

10. A sheet feeder comprising a stack hopper for holding a stack of sheets, a first rotatable shaft positioned under said stack of sheets, a motor operatively connected to drive said first shaft, and a second, idler shaft, parallel to said first shaft, spaced forward of a leading edge of said stack, and a plurality of feed belts extending around and between said first shaft and said second shaft, at least one of said feed belts being movable laterally along said constant diameter shafts toward and away from another of said feed belts while said feed belts are being driven.

11. The sheet feeder of claim 10 including at least one support shaft positioned between an upper reach of said feed belts and a lower reach of said feed belts intermediate said first and second shafts.

12. The sheet feeder of claim 10 including a multiplicity of feed belts, and wherein all of said multiplicity of feed belts are movable laterally toward and away from the others of said feed belts.

13. The feeder of claim 10 including sheet separators mounted on a bridge forward of said stack but closely adjacent thereto, said separators being positioned between said movable belts and an adjacent belt, and projecting a short distance below the upper surface of said belts, whereby said sheet being conveyed by said belts is buckled to facilitate separation of said bottom sheet from the rest of the stack.

14. The feeder of claim 13 wherein each of said separators comprises a tip with one curved face positioned initially to engage said bottom-most sheet, said tip being detachably secured to a block carried by a bracket mounted on a bridge and carrying means for moving said slide, hence said block, in a direction toward and away from said upper surface of said feed belts to adjust for various thickness of sheet.

15. The feeder of claim 14 wherein said separators are individually adjustable.

16. The feeder of claim 14 wherein said separators are mounted for lateral movement toward and away from one another independently.

* * * * *

UNITED STATES PATENT AND TRADEMARK OFFICE

CERTIFICATE OF CORRECTION

PATENT NO. : 7,624,978 B2
APPLICATION NO. : 11/145855
DATED : December 1, 2009
INVENTOR(S) : James C. Kaiping It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 717 days.

Signed and Sealed this

Twenty-sixth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,624,978 B2
APPLICATION NO. : 11/145855
DATED : December 1, 2009
INVENTOR(S) : James C. Kaiping It is certified that error appears in the above-identified patent and that said Letters Patent is hereby corrected as shown below:

Title Page, Item (54), Title delete the word "AN" between TOWARD and AWAY and replace it with the word --AND--. The title should read SHEET FEEDER WITH FEED BELTS THAT MOVE TOWARD AND AWAY FROM EACH OTHER.

Signed and Sealed this
Nineteenth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 7,624,978 B2
APPLICATION NO. : 11/145855
DATED : December 1, 2009
INVENTOR(S) : James C. Kaiping It is certified that error appears in the above-identified patent and that said Letters Patent is hereby corrected as shown below:

Title Page, Item (54) and at Column 1, lines 1-3, Title delete the word "AN" between TOWARD and AWAY and replace it with the word --AND--. The title should read SHEET FEEDER WITH FEED BELTS THAT MOVE TOWARD AND AWAY FROM EACH OTHER.

This certificate supersedes the Certificate of Correction issued February 19, 2013.

Signed and Sealed this
Nineteenth Day of March, 2013

Teresa Stanek Rea
*Acting Director of the United States Patent and Trademark Office*